US008180089B2

(12) United States Patent
Yang

(10) Patent No.: US 8,180,089 B2
(45) Date of Patent: May 15, 2012

(54) EARPHONE

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 1364 days.

(21) Appl. No.: 11/609,907

(22) Filed: Dec. 13, 2006

(65) Prior Publication Data

US 2008/0049959 A1 Feb. 28, 2008

(30) Foreign Application Priority Data

Aug. 23, 2006 (TW) ..... 95130956 A

(51) Int. Cl.
*H04R 25/00* (2006.01)

(52) U.S. Cl. ..... 381/370; 381/182

(58) Field of Classification Search ..... 381/309, 381/370–376, 300, 307, 335, 336, 308; 181/129
See application file for complete search history.

(56) References Cited

U.S. PATENT DOCUMENTS

| | | | | |
|---|---|---|---|---|
| 2004/0218775 | A1* | 11/2004 | Huang | 381/371 |
| 2005/0207606 | A1* | 9/2005 | Yang | 381/370 |
| 2005/0207607 | A1* | 9/2005 | Yang | 381/382 |

FOREIGN PATENT DOCUMENTS

| | | |
|---|---|---|
| CN | 1694573 | 11/2005 |
| DE | 102004035355 | 10/2005 |
| EP | 1 608 204 | 12/2005 |
| JP | 57-3498 | 1/1982 |
| JP | 2003-199187 | 7/2003 |
| JP | 2005-278138 | 10/2005 |
| JP | 2005-278177 | 10/2005 |
| JP | 2005-354560 | 12/2005 |
| WO | WO2004040941 | 5/2004 |

OTHER PUBLICATIONS

"Invitation to Submit Applicant's Opinion from the Appeal Board of Japan Counterpart Application" issued on Jul. 20, 2010, p. 1-p. 2.
"1st Office Action of China Counterpart Application" issued on Oct. 8, 2010, p. 1-p. 3.

* cited by examiner

*Primary Examiner* — Curtis Kuntz
*Assistant Examiner* — Sunita Joshi
(74) *Attorney, Agent, or Firm* — Jianq Chyun IP Office

(57) ABSTRACT

An earphone including a case, a case extension unit, a plate, a cover, a first speaker and a second speaker is provided. The first speaker is disposed on a supporting portion of the plate and is disposed on a first plane different from a second plane where the second speaker is located. A distance exits in the position of the first speaker and the position of the second speaker corresponding to a direction of the sound from the earphone to the user who wears the earphone. The distance variation can make the sound field have more special effects and have better frequency response in some frequency domain. The distance variation can also avoid the interference of different sound fields generated by the speakers inside the earphone, and thus improves the performance of the whole sound field.

8 Claims, 3 Drawing Sheets

EARPHONE

CROSS-REFERENCE TO RELATED APPLICATION

This application is a continuation-in-part application of patent application Ser. No. 10/709,956, filed on Jun. 9, 2004, and is now issued as U.S. Pat. No. 7,463,748. This application is also a continuation-in-part application of patent application Ser. No. 10/907,047, filed on Mar. 17, 2005, and is now issued as U.S. Pat. No. 7,289,641. This application claims the priority benefit of Taiwan application serial no. 95130956, filed Aug. 23, 2006. All disclosure of the Taiwan application is incorporated herein by reference.

BACKGROUND OF THE INVENTION

1. Field of the Invention

The present invention relates to an earphone, and more particularly, to the one that has plural speakers.

2. Description of Related Art

With the development of technology, digital entertainments become popular in our daily life. For example, the Digital Video Disc (DVD) has become a common household video player. The DVD player is basically equipped with the decoding function for the Dolby Digital System or Digital Theater System to decode the digital signal and output an analog signal to speakers, and then the speakers send out sounds. Multi-channel speakers are indispensable for a high quality digital entertainment in the daily life. Speakers with 5.1 channels are the familiar multi-channel speakers.

Nevertheless, in some circumstances where sounds may disturb other people, the speakers are prohibited. Instead, an earphone is a better choose. Designs for integrating higher quality multi-channel sound sources with slimmer earphones have been provided. Since the space in the earphone is not as large as the home theater, digital processing for sound signals is adopted by such as circuit design to obtain multi-channel surrounding sound effects, wherein the sound signals can be controlled through the digital processing, but relatively, the output sound field is inferior. Compare to the multi-channel speakers in the home theater, the conventional earphone is incapable of providing as such high sound quality and sound effects as the multi-channel speakers.

SUMMARY OF THE INVENTION

The present invention provides an earphone which is capable of preventing the interference of sound fields generated by different speakers inside the earphone.

As embodied and broadly described herein, the present invention is directed to an earphone including a case, a case extension unit, a plate, a cover, a first speaker and a second speaker. The case extension unit extends from the case. The plate is disposed on the case extension unit and forms a space for being as a main sound field with the case; The cover is disposed on the case extension unit and is located on an external side of the plate, in opposite to the space for covering the case. The first speaker is disposed on a supporting portion of the plate and is disposed on a first plane different from a second plane where the second speaker is located, to form a distance in the position of the first speaker and the position of the second speaker corresponding to a direction of the sound from the earphone to the user who wears the earphone.

The second speaker is disposed on the plate and the distance in the position of the first speaker and the position of the second speaker corresponding to a direction of the sound from the earphone to the user who wears the earphone is the height of the supporting portion. The first speaker or the second speaker is one of a main speaker with 2.1 channels and a subwoofer speaker with 2.1 channels.

According to an embodiment of the present invention, a composite chamber is disposed on the plate and the second speaker is disposed in the composite chamber with a third speaker and a fourth speaker. In an embodiment, the first speaker is a main speaker with 5.1 channels and the second speaker is a subwoofer speaker with 5.1 channels. The third speaker and the fourth speaker are a center speaker with 5.1 channels and a surrounding speaker with 5.1 channels respectively.

In order to the make aforementioned and other objects, features and advantages of the present invention comprehensible, a preferred embodiment accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
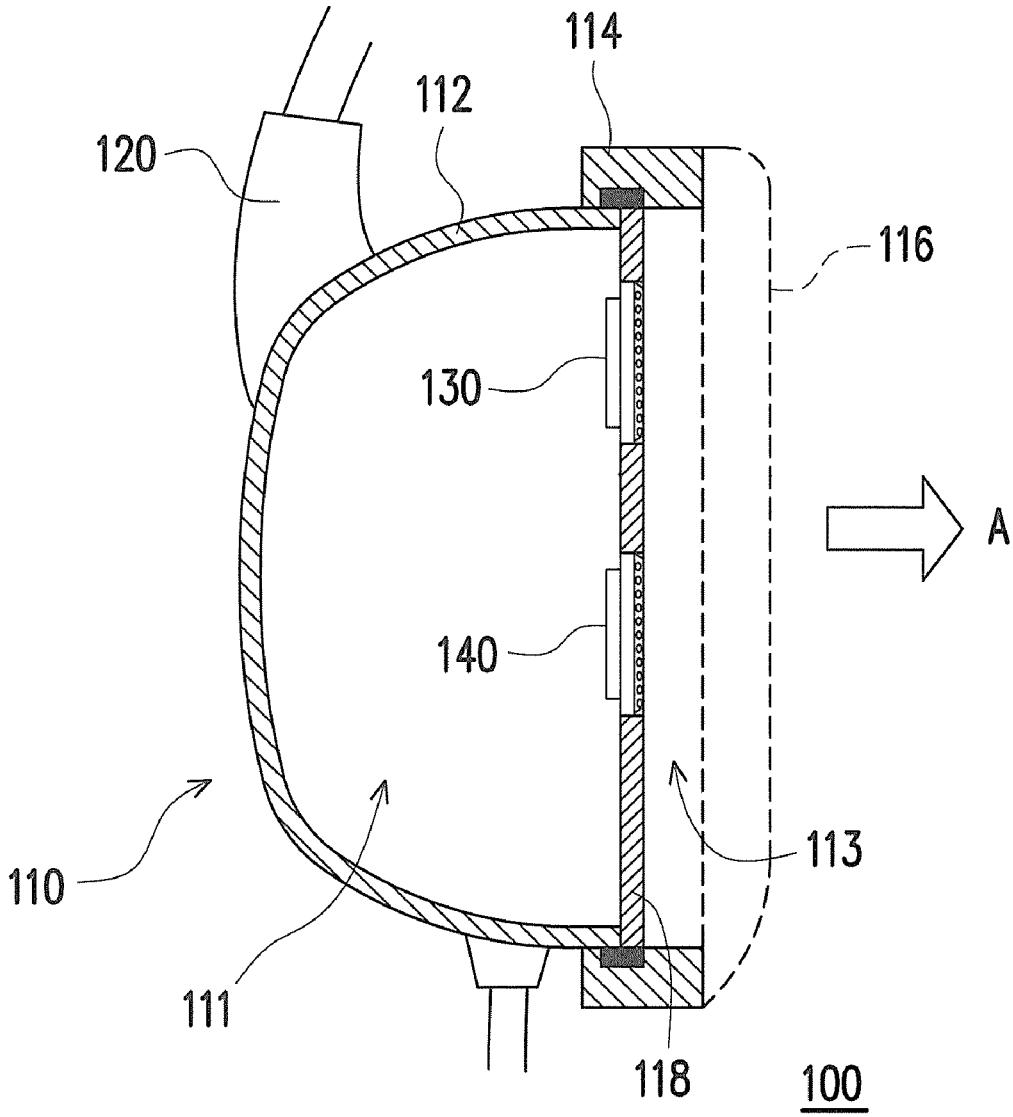
FIG. 1 (RELATED ART)
FIG. 1 shows a conventional earphone with 2.1 channels.

Reference will now be made in detail to the present preferred embodiments of the invention, examples of which are illustrated in the accompanying drawings. Wherever possible, the same reference numbers are used in the drawings and the description to refer to the same or like parts.

The earphone of the present invention is one of optimum designs of a series of multi-channel earphones developed by the applicants. The features of the earphone of the present invention include modifying the chamber of the earphone and adjusting the volume of the chamber to improve the sound performance, which can be referred to TW Patent Application No. 93107621 filed on Mar. 22, 2004 and entitled "Earphone Structure with Composite Sound Field", TW Patent Application No. 93111985 filed on Apr. 29, 2004 and entitled "Earphone Structure with Composite Sound Field", TW Patent Application No. 94103553 filed on Feb. 4, 2005 and entitled "Multiple Channel Earphone", TW Patent Application No. 95105609 filed on Feb. 20, 2006 and entitled "Multiple Channel Earphone", or TW Patent Application No. 95120518 filed on Jun. 9, 2006 and entitled "Earphone with Sound Guiding Tube". The contents of said applications should be incorporated herein for reference and detailed descriptions are omitted.

Specifically, the multi-channel earphones mentioned above disclose techniques which make efforts in improving the extensity and the factuality of the sound field to approach sound effects, such as the multi-channel surrounding sound effect, provided by multiple channel speakers in the home theater. Thus, any improvement tends to the object. The earphone of the present invention can provide sound field with more special effects and have better frequency response in some frequency domains. Moreover, the earphone of the present invention can also avoid the interference of sound fields generated by different speakers inside the earphone, and thus improves the performance of the whole sound field.

In order to provide a sound field with more special effects and avoid the problem of interference, an embodied earphone 200 of the present invention has one of a main speaker 230 and a subwoofer speaker 240 disposed in an extension chamber 213 of a case extension unit 214. Due to the distance variation of the main speaker 230 and the subwoofer speaker 240, the sound field with more special effects can be obtained when the main speaker 230 and the subwoofer speaker 240 send out sounds simultaneously.

With respect to a sound source with 2.1 channels, a main speaker and a subwoofer speaker are required in an earphone. FIG. 1 shows one side of an earphone 100 with 2.1 channels. However, it is well known to the people skilled in the art that another side of the earphone 100 is similar to that illustrated in FIG. 1, and the detailed description thereof is omitted.

The earphone 100 comprises a main body 110 and a connecting attachment 120. The main body 110 comprises a case 112, a case extension unit 114 and a cover 116. The case extension unit 114 extends from the case 112 and connects the cover 116. The main body 110 has a plate 118 therein for fixing a main speaker 130 and a subwoofer speaker 140. The main speaker 130 and the subwoofer speaker 140 are disposed within the main body 110 and receive the sound source with 2.1 channels through the connecting attachment 120. Different sound signals can be input to the main speaker 130 and the subwoofer speaker 140 respectively to provide superior stereo sound effect. The main speaker 130 and the subwoofer speaker 140 of the earphone 100 are disposed on the plate 118 in the main body 110. In other words, the main speaker 130 and the subwoofer speaker 140 are arranged on the same plane for sending out the sounds to users along direction A. Thus, there exists no distance variation in the sound field along the same direction when the main speaker 130 and the subwoofer speaker 140 send out sounds simultaneously. Accordingly, interference between the main sound field 111 within the main body 110 and the extension sound field 113 within the case extension unit 114 occurs and degrades the performance of the earphone 100, especially in the low frequency domain.

In order to produce more sound effects by multi-channel sound source in the earphone, the present invention provides a structure of earphone, which improves the sound effects and prevents the interference by modifying the spatial arrangement in the earphone.

Figure 2:
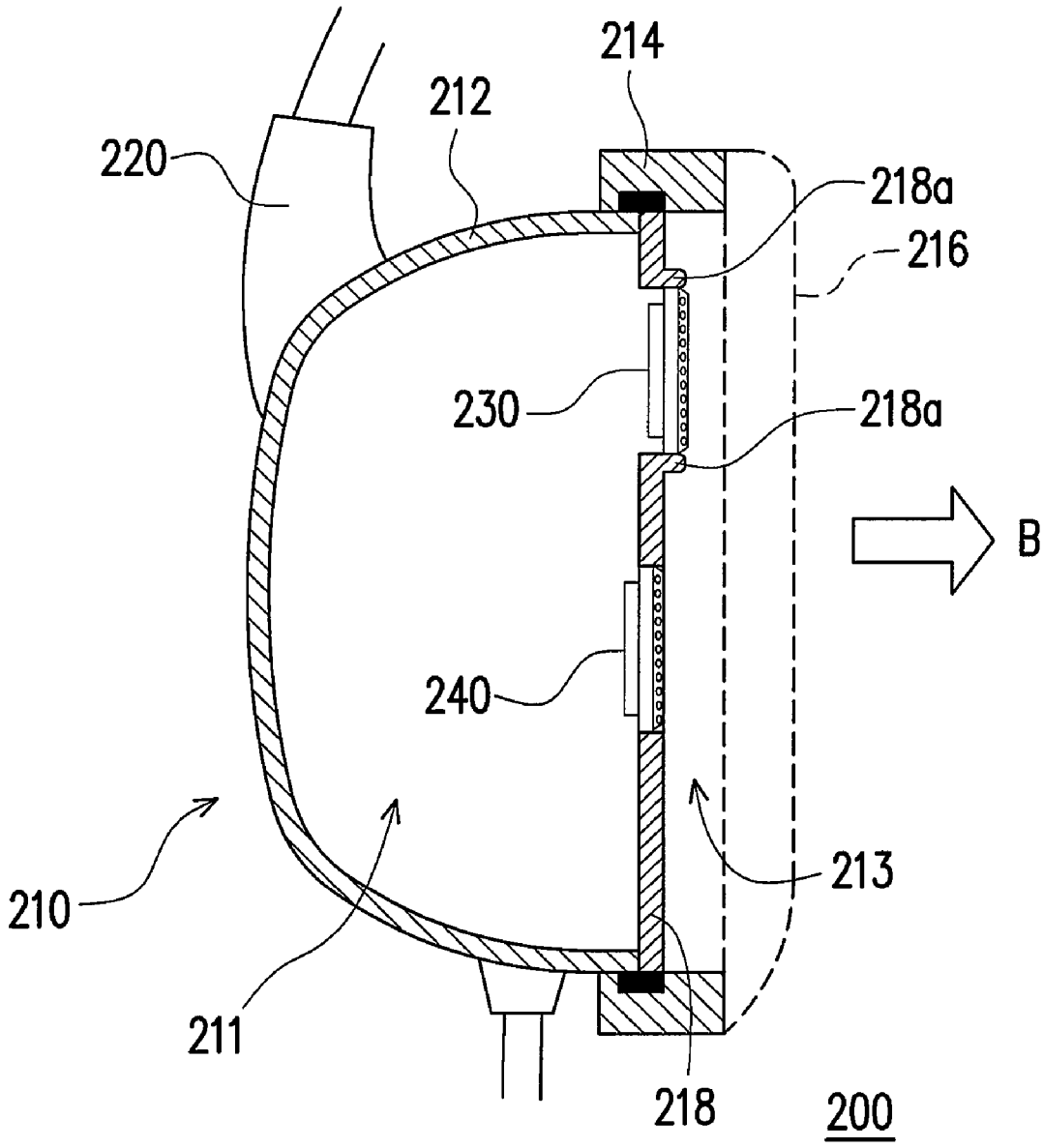
FIG. 2 shows an earphone with 2.1 channels according to an embodiment of the present invention.

FIG. 2 shows an earphone with 2.1 sound channels according to an embodiment of the present invention. It is noted that FIG. 2 shows one side of the earphone of the present invention, but it is well known to the people skilled in the art that another side of the earphone is similar to that illustrated in FIG. 2, and thus detailed description thereof is omitted.

Referring to FIG. 2, an earphone 200 with 2.1 channels comprises a main body 210 and a connecting attachment 220. The main body 210 comprises a case 212, a case extension unit 214 and a cover 216. The case extension unit 214 extends from the case 212 and connects the cover 216. The main body 210 has a plate 218 therein for fixing a main speaker 230 and a subwoofer speaker 240. The main speaker 230 and the subwoofer speaker 240 are disposed within the main body 210 and receive the sound source with 2.1 channels. Different sound signals can be input to the main speaker 230 and the subwoofer speaker 240 respectively to provide superior stereo sound effect. Additionally, the positions of the main speaker 230 and the subwoofer speaker 240 can be exchanged with each other in another embodiment of the present invention without departing from the scope of the present invention.

In order to make the sound field have more special effect and avoid the interference of sound fields generated by the speakers inside the earphone, the present invention disposed one of the main speaker 230 and the subwoofer speaker 240 in an extension chamber 213 of the case extension unit 214. Therefore, the distance from the main speaker 230 to a user and the distance from the subwoofer speaker 240 to the user are different. Due to the spatial and distance variation of the main speaker 230 and the subwoofer speaker 240, the sound field with more special effects can be obtained when the main speaker 230 and the subwoofer speaker 240 send out sounds simultaneously.

In the earphone 200 of the embodiment, the plate 218 has a supporting portion 218*a* protruding from the surface of the plate 218, and the main speaker 230 is disposed on the supporting portion 218*a*. In other words, the main speaker 230 and the subwoofer speaker 240 are disposed on different planes. Referring to FIG. 2, the main speaker 230 is disposed in the extension chamber 213 of the case extension unit 214 to produce the distance variation of the main speaker 230 and the subwoofer speaker 240. Along the direction B from the earphone 200 to the user, the main speaker 230 is closer to the user as compared to the subwoofer speaker 240. Thus, interference between the sound field produced by the main speaker 230 and the sound field produced by the subwoofer speaker 240 can be prevented due to the distance variation. Moreover, the sound effects of the whole sound field can be improved. According to practical experiments, it is found that the earphone 200 of the embodiment provides superior effect and gets good frequency response especially in the low frequency domain.

The position of the main speaker 230 and the position of the subwoofer speaker 240 can be exchanged with each other, which can be adjusted according to the design or other requirements.

For example, an earphone may accentuate the main sound channel or the subwoofer effect.

In another embodiment, the position of the main speaker 230 and the subwoofer speaker 240 can be exchanged. Specifically, the subwoofer speaker can be disposed in the extension chamber 213 of the case extension unit 214 to produce the distance variation of the main speaker 230 and the subwoofer speaker 240. Along the direction B from the earphone 200 to the user, the subwoofer speaker 240 is closer to the user as compared to the main speaker 230.

In order to produce more sound effects form multi-channel sound source in the earphone, the present invention provides a structure of earphone, which improves the sound effects and prevents the interference by modifying the spatial arrangement in the earphone. The aforementioned design is also suitable for other multi-channel earphones, such as 5.1 channels or 7.1 channels earphones. More particular, it is suitable for the multi-channel earphones mentioned in the aforementioned series of patent applications to improve the sound effects of the earphone.

Figure 3:
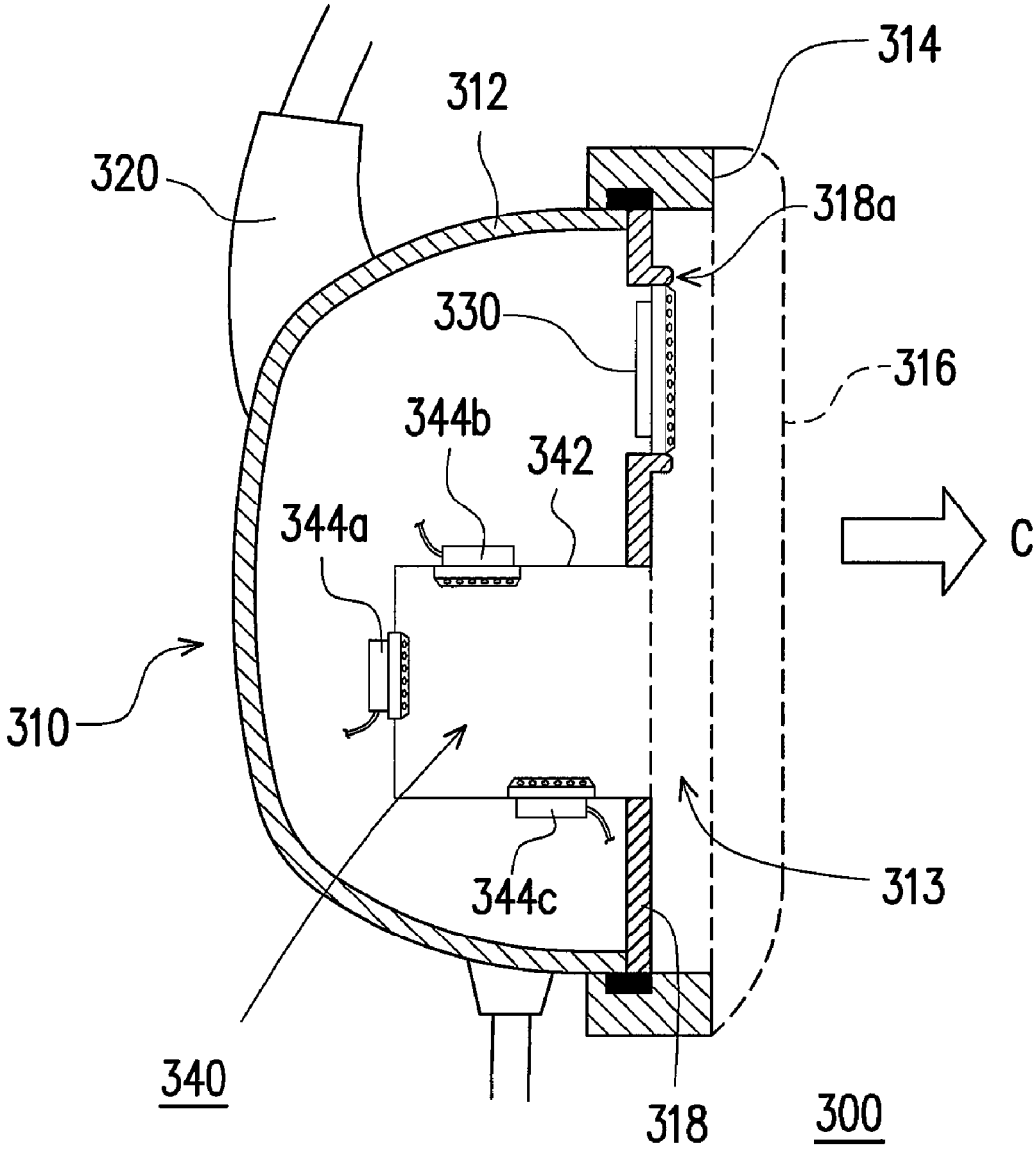
FIG. 3 shows an earphone with 5.1 channels according to an embodiment of the present invention.

FIG. 3 shows an earphone with 5.1 sound channels according to an embodiment of the present invention. Similarly, FIG. 3 shows one side of the earphone of the present invention, but it is well known to the people skilled in the art that another side of the earphone is similar to that illustrated in FIG. 3, and thus detailed description thereof is omitted.

Referring to FIG. 3, an earphone 300 with 5.1 channels comprises a main body 310 and a connecting attachment 320. The main body 310 comprises a case 312, a case extension unit 314 and a cover 316. The case extension unit 314 extends from the case 312 and connects the cover 316. The main body 310 has a plate 318 therein for fixing a main speaker 330 and a composite chamber 340. The composite chamber 340 comprises a chamber 342 and plural sub-speakers 344*a*, 344*b* and 344*c*.

The chamber 342 is disposed on the plate 318 and the outlet of the chamber 342 faces the user. The sub-speakers 344*a*, 344*b* and 344*c* are disposed within the chamber 342. The sub-speakers may be the subwoofer speaker 344*a*, the first speaker 344*b* and the second speaker 344*c*. Referring to FIG. 3, the subwoofer speaker 344*a* is disposed at the rear of the chamber 342. The first speaker 344*b* and the second speaker 344*c* are disposed at the two opposite sides of the chamber 342 respectively for being as a center speaker or a surrounding speaker of a 5.1 channels earphone. However, the embodiment and FIG. 3 are exemplary, and the present invention is not limited thereto.

The arrangements of the main speaker 330 and the composite chamber 340, such as the size of the chamber 342, the positions of the sub-speakers 344*a*~344*c*, can be referred to the multi-channel earphones mentioned in the aforementioned series of patent applications. Specifically, TW Patent Application No. 93107621 entitled "Earphone Structure with Composite Sound Field" provides a technique which improves the sound quality by modifying the structure or the volume of the chamber of the earphone. Furthermore, different improvements can be obtained according to the arrangements of the earphones disclosed in the aforementioned patent applications, such as TW Patent Application No. 93107621 entitled "Earphone Structure with Composite Sound Field", TW Patent Application No. 93111985 entitled "Earphone Structure with Composite Sound Field", TW Patent Application No. 94103553 entitled "Multiple Channel Earphone", and TW Patent Application No. 95105609 entitled "Multiple Channel Earphone".

In the earphone 300 of the embodiment, the plate 318 has a supporting portion 318*a* protruding from the surface of the plate 318, wherein the composite chamber 340 is disposed on the surface of the plate 318 and the main speaker 330 is disposed on the supporting portion 318*a*. In other words, the main speaker 330 and the composite chamber 340 are disposed on different planes. The main speaker 330 is disposed in the extension chamber 314 of the case extension unit 313 to produce the distance variation of the main speaker 330 and the composite chamber 340. Along the direction C from the earphone 300 to the user, the main speaker 330 is closer to the user as compared to the composite chamber 340. Thus, interference between the sound field produced by the main speaker 330 and the sound field produced by the composite chamber 340 can be prevented due to the distance variation. Moreover, the sound effects of the whole sound field can be improved.

It will be apparent to persons of ordinary skill in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An earphone, comprising:

a case;

a case extension unit extending from the case;

a plate disposed on the case extension unit and forming a space for being as a main sound field with the case;

a cover disposed on the case extension unit and located on an external side of the plate, in opposite to the space for covering the case;

a first speaker and a second speaker, wherein the first speaker is disposed on a supporting portion of the plate and the second speaker is disposed directly on the plate, wherein the supporting portion is protruding from a surface of the plate and is extended into the extension chamber of the case extension unit and the first speaker is disposed in the extension chamber of the case extension unit, wherein the first speaker is disposed on a first plane different from a second plane where the second speaker is located to form a distance in the position of the first speaker and the position of the second speaker corresponding to a direction of the sound from the earphone to the user who wears the earphone, so as to avoid interference inside the earphone, wherein the position of the first speaker is closer to an ear of the user than the second speaker.

2. The earphone of claim 1, where in the first speaker is a main speaker with 2.1 channels.

3. The earphone of claim 2, where in the second speaker is a subwoofer speaker with 2.1 channels.

4. The earphone of claim 1, where in the first speaker is a subwoofer speaker with 2.1 channels.

5. The earphone of claim 4, where in the second speaker is a main speaker with 2.1 channels.

6. The earphone of claim 1, wherein a composite chamber is disposed on the plate and the second speaker is disposed in the composite chamber with a third speaker and a fourth speaker.

7. The earphone of claim 6, where in the first speaker is a main speaker with 5.1 channels and the second speaker is a subwoofer speaker with 5.1 channels.

8. The earphone of claim 7, wherein the third speaker and the fourth speaker are a center speaker with 5.1 channels and a surrounding speaker with 5.1 channels respectively.

* * * * *